US006186621B1

(12) United States Patent
Pew

(10) Patent No.: US 6,186,621 B1
(45) Date of Patent: Feb. 13, 2001

(54) VOLUMETRICALLY EFFICIENT PRINTER INK SUPPLY COMBINING FOAM AND FREE INK STORAGE

(75) Inventor: Jeffrey K. Pew, Lake Oswego, OR (US)

(73) Assignee: Hewlett-Packard Company, Palo Alto, CA (US)

( * ) Notice: Under 35 U.S.C. 154(b), the term of this patent shall be extended for 0 days.

(21) Appl. No.: 09/229,219

(22) Filed: Jan. 12, 1999

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS

| | | | |
|---|---|---|---|
| 4,791,438 | 12/1988 | Hanson et al. | 347/87 |
| 4,794,409 | 12/1988 | Cow ger et al. | 347/87 |
| 5,010,354 | 4/1991 | Cow ger et al. | 347/87 |
| 5,113,199 | 5/1992 | Chan et al. | 347/87 |
| 5,509,140 | 4/1996 | Koitbashi | 347/86 |
| 5,557,310 | 9/1996 | Kurata et al. | 347/87 |

FOREIGN PATENT DOCUMENTS

| | | | |
|---|---|---|---|
| 0646465 | 4/1995 | (EP) | B41J/2/175 |
| 0791466 | 8/1997 | (EP) | B41J/2/175 |
| 2297724 | 8/1996 | (GB) | B41J/2/175 |

*Primary Examiner*—N. Le
*Assistant Examiner*—Anh T. N. Vo

(57) ABSTRACT

An ink supply is contained in a manner that combines foam and free ink storage to provide high volumetric efficiency, back pressure regulation to protect against ink leakage, and a generally lower cost, easy-to-manufacture assembly. Ink leakage protection is present despite exposure of the supply to substantial variations in temperature and ambient air pressure. The container is divided, and part of the container includes porous material for storing ink. Capillary pressures of the material and of a bubble generator in the free-ink part of the container are selected to control the sequence with which ink is removed from the container parts.

18 Claims, 1 Drawing Sheet

VOLUMETRICALLY EFFICIENT PRINTER INK SUPPLY COMBINING FOAM AND FREE INK STORAGE

TECHNICAL FIELD

This invention relates to an ink supply container that combines foam based and free storage of ink in a manner that provides high volumetric efficiency and protection against ink leakage.

BACKGROUND AND SUMMARY OF THE INVENTION

Replaceable ink supplies are important components of ink-jet type printers. The ink supply provides ink to a printhead that is carried in what may be called the pen of the printer. The printhead typically includes a plurality of orifices, each orifice having an associated chamber. Ink is channeled to the chamber from the ink supply. During operation of the printhead, ink droplets are fired from the chambers, through the orifices, to a printing medium such as paper.

In thermal-type printheads, the ink droplets are fired as a result of rapidly heating the ink in the chamber by an amount sufficient to vaporize a portion of that ink. The resultant, rapid expansion of the vapor bubble in the chamber forces out of the chamber a correspondingly sized droplet.

Some printer designs separate the ink supply from the printhead, which printhead is normally mounted to a carriage to reciprocate along the width of paper that is advanced through the printer. The supply resides in the printer, and an elongated tube or other means is used for interconnecting the supply to the printhead.

Although the printhead is a reliable and efficient means for firing ink droplets, it carries no mechanism for preventing the free flow of ink through the orifices when the printhead is not operating. As a result, ink supplied to the printhead is usually provided under a slight under pressure or back pressure. The back pressure is large enough to prevent the free flow of ink from the pen, but not so large as to prevent an activated printhead from expelling ink. This range of back pressures will be referred to as the printhead's operating range. As used here, a positive back pressure refers to a pressure within the printhead (or ink supply) that is less than ambient pressure. Thus, an increase in back pressure means an increase in the difference between ambient pressure and the relatively lower back pressure.

The back pressure at the printhead must be maintained within a fairly narrow operating range (to prevent leakage without causing the printhead to fail) despite severe changes in the ambient temperature and pressure that may occur, for example, when a printer is subject to altitude changes during shipping, etc. A large ambient pressure drop, for example, could overcome the back pressure in the printhead and cause ink to leak or "drool" from it. Thus, printers are provided with mechanisms that compensate for such changes. One class of mechanisms, which may be referred to as accumulators, are designed to expand and contract or otherwise compensate for pressure or volume changes inside the pen that are attributable to ambient pressure changes.

Accumulator mechanisms are sometimes supplemented with "bubble generators." A bubble generator is an orifice or tubular member formed in the ink supply reservoir to allow, under certain conditions, fluid communication between the interior of the reservoir and the ambient atmosphere. The opening of the bubble generator is sized to have capillarity or capillary pressure sufficient to retain a quantity of ink in the opening as a liquid seal. The geometry of that opening is such that when the back pressure approaches the limit of the operating range of the printhead, the back pressure overcomes the capillary pressure of the bubble generator and the liquid seal is broken. Ambient air then "bubbles" into the reservoir to reduce the back pressure to an acceptable level. Ideally, when the back pressure is so reduced, ink from the reservoir reenters the orifice to reestablish the liquid seal.

Open-cell foam has been used as a storage medium in ink supplies. The capillary pressure of the foam provides a simple mechanism for providing back pressure for the supply. In this regard, capillary pressure is the pressure applied by a capillary member, such as the connected cells in reticulated foam, to a liquid that it contacts, such as ink. For example, foam material having a capillary pressure of 7 centimeters water column would store the ink in its cells until a suction greater than that pressure is applied to it.

The volumetric efficiency of an ink supply generally means the amount of ink deliverable from the supply reservoir divided by the reservoir volume. When the entire ink supply is stored in foam the volumetric efficiency of the supply suffers because of the presence of the foam material throughout the supply. The solid parts of the foam material fills volume that may otherwise be used to store ink. High volumetric efficiency is desirable for enabling as much ink as possible to be delivered to the printhead (hence to the paper) for a given size ink supply.

Another disadvantage with all-foam type supplies is that the level of available ink in the supply may not be as readily detectable as would be the case if the supply consisted of free ink having a discernable level.

Ink supplies that are contained free (that is, without the use of porous, absorbent material, such as the foam mentioned above) offer high volumetric efficiency along with a free-ink surface for detecting the ink level. Mechanisms necessarily associated with such supplies for regulating back pressure, however, tend to be complex and relatively difficult to manufacture.

The present invention is directed to an ink supply contained in a manner that combines foam and free ink storage to provide high volumetric efficiency, back pressure regulation to protect against ink leakage, and a generally lower cost, easy-to-manufacture assembly.

In a preferred embodiment of the invention, the container comprises a reservoir that is divided into two parts. One part stores free ink, and another part holds porous, absorbent "accumulator" material that stores ink and has a capillary pressure sufficient to provide back pressure in the supply.

Porous wicking material is in the reservoir, arranged to be in fluid communication with the free ink and with the ink in the accumulator material. The wicking material delivers both the free ink and ink in the accumulator material to an outlet in the reservoir.

A bubble generator is provided to connect the free-ink part of the reservoir to the ambient atmosphere. The bubble generator is designed to have a capillary pressure that is significantly higher than the capillary pressure of the accumulator material. As such, ink removed from the supply is first drawn from the accumulator material, which thus allows that drained material to thereafter act as an accumulator in the event of severe pressure or temperature changes as mentioned above.

After ink is removed from the accumulator material, ink is drawn via the wicking material from the free-ink supply. The bubble generator permits ingress of air as this ink is removed, thereby ensuring that the back pressure in the supply does not rise so high as to cause the printhead to fail.

The volumetric efficiency of the present supply is enhanced in a number of ways. For example, the significantly greater capillary pressure of the bubble generator as compared to that of the accumulator material ensures that nearly all of the ink in the accumulator material will be removed before the free-ink supply is depleted. Thus, the porous material of the accumulator will hold very little "stranded" ink when the supply is otherwise fully depleted.

In one embodiment of the invention, the porous material used for the accumulator material is selected to be very wettable (i.e., a zero or near-zero contact angle between the ink and surface of the material). This facilitates movement of ink from the accumulator to further minimize the amount of stranded ink.

The porous wicking material is selected to have a capillary pressure that is higher than that of both the accumulator material and the bubble generator. As such, the wicking material remains saturated with ink at least until all of the available accumulator ink and free ink is removed from the supply. Consequently, the wicking material provides a reliable mechanism for ensuring delivery of ink out of the supply.

The supply of the present invention is adaptable to be remote from the printhead, and configured with an outlet that receives a fluid interconnect mechanism for conducting ink from the supply to the printhead. A negative (suction) pressure is applied via the interconnect to remove the ink. In one embodiment, the capillary pressure of the wicking material is selected to be great enough so that ink is retained within the wicking material after removal of the accumulator ink and free ink. This design ensures that the wicking material will remain at least partly saturated, which is necessary in some instances to ensure fluidic coupling with the interconnect. This design may be useful, for example, when the fluid interconnect is periodically made and broken throughout the useable life of ink supply.

In another embodiment, the capillary pressure of the wicking material, while greater than that of both the bubble generator and the accumulator material, is established to be low enough to permit the suction of the interconnect to drain ink from the wicking material. Such a design may be useful, for example, in instances where the fluid interconnect is made to a full supply and not broken until the entire supply is depleted. It will be appreciated that this approach enhances the volumetric efficiency of the supply by increasing the amount of deliverable ink (that is, to include what is stored in the wicking material) for a given size of supply container.

As another aspect of this invention, there is provided a method for optimizing the design of the accumulator part of the ink supply so that the accumulator goals (providing back pressure regulation to avoid ink drool despite extreme changes in ambient pressure) are met with the smallest amount of accumulator material required. Minimizing the amount of accumulator material thereby minimizes the amount of ink that may be stranded in the accumulator material, which in turn increases volumetric efficiency.

Inasmuch as a part of the present supply contains free ink, the level of ink remaining in the supply is available for detection.

Other advantages and features of the present invention will become clear upon study of the following portion of this specification and the drawings.

DETAILED DESCRIPTION OF PREFERRED EMBODIMENTS

Figure 1:
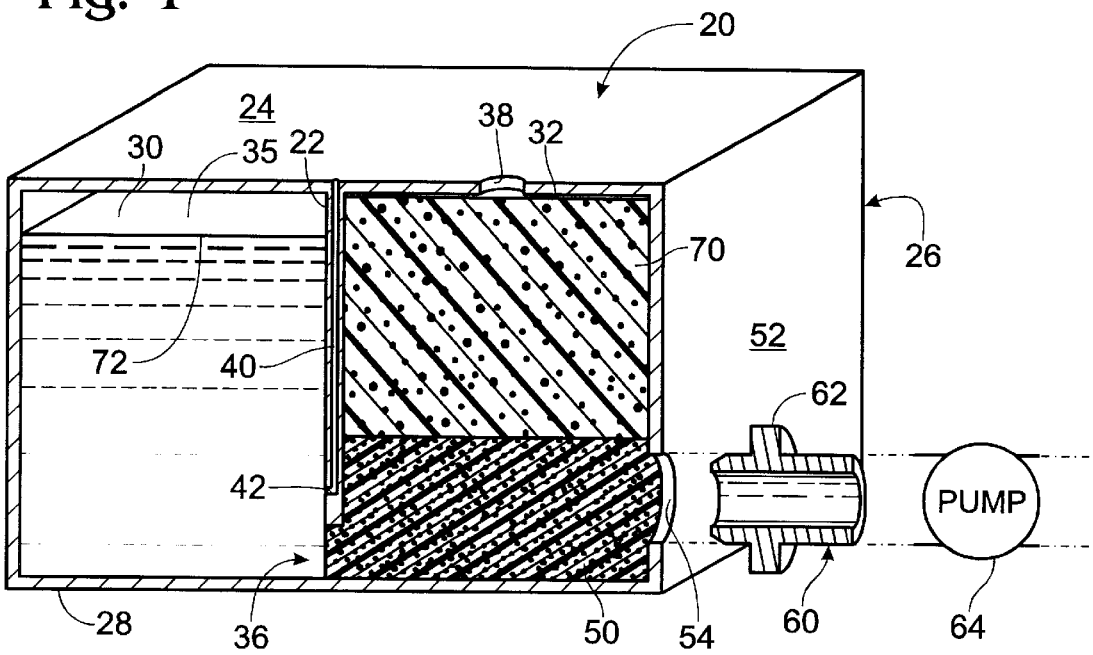
FIG. 1 is a cross sectional diagram of an ink supply in accordance with the present invention.

With reference to FIG. 1, an ink supply in accordance with the present invention includes a container 20 that may be formed of any suitable lightweight material, such as plastic, that does not react with the ink it contains. FIG. 1 shows one preferred embodiment of the container 20 in cross section, with the removed portion being substantially the mirror image of the portion that is shown. It is contemplated that the principles of the present invention described below may be applied to a wide range of container configurations.

The container 20 includes a divider 22 that may be in the form of an integrally formed plastic wall extending downwardly from the top 24 and between the two container sidewalls, only one of which sidewalls 26 appears in FIG. 1.

The divider 22 separates the container into two reservoir volumes: a free-ink volume 30, and a capillary volume 32. Each of these volumes stores ink, as will be explained.

The divider 22 is spaced from the container bottom wall 28 so that a gap 36 is present between the bottom wall 28 and the lowermost edge of the divider 22. The gap 36 provides for fluid communication between the free-ink volume 30 and the capillary volume 32.

The container 20 also includes a vent 38, which vents the upper portion of the capillary volume 32 to ambient. Preferably, the vent 38 is sized so that it also serves as a diffusion barrier to limit mass diffusion of ink through the vent. One of ordinary skill could select a combination of vent diameter and length (The top 24 could be thickened in the vent area for providing adequate length.) so that, in accord with Fick's first law of diffusion, a working vent is in place to provide an acceptably low rate of mass diffusion for the capillary volume 32.

The free-ink volume 30 is also in fluid communication with ambient atmosphere outside the container 20. In this regard, a bubble generator 40 is incorporated into the divider 22. As mentioned above, a bubble generator 40 permits, under certain circumstances, entry of ambient air bubbles into the ink-filled, free-ink volume 30. The opening of the bubble generator 40 is sized to have capillary pressure sufficient to retain a quantity of ink in the lower end 42 of the opening as a liquid seal. When the back pressure inside the free-ink volume 30 approaches an upper limit, which corresponds to the limit of the operating range of the printhead, the back pressure overcomes the capillary pressure of the bubble generator and the liquid seal is broken. Ambient air then bubbles into the reservoir to reduce the back pressure to an acceptable level. Ideally, when the back pressure is so reduced, ink from the volume 30 reenters the orifice to reestablish the liquid seal.

As noted earlier, back pressure is referred to in a positive sense and quantified, for example, in terms of water column height. Capillary pressure, such as that of the bubble generator 40 is similarly measured. The significance of the relative values of the back pressure operating range and the capillary pressures of the various components of the present invention is described more fully below. It is noteworthy here, however, that any of a variety of bubble generator configurations may be employed with the present container configuration. For example, the bubble generator may be a separate, tubular member extending from near the bottom of the free-ink volume to terminate at any exterior wall of the container. Also, the above-mentioned vent 38 may be incorporated with or joined to the outer end of the bubble generator.

The capillary volume 32 includes wicking material 50, which is placed into the bottom of that volume in contact with both sidewalls and with the front wall 52 of the container 20. Part of the wicking material 50 is fit under the divider 22 to occlude the gap 36 so that ink passing through the gap must pass into the wicking material 50.

In a preferred embodiment, the wicking material comprises a porous material that can be generally characterized as "foam," but can be selected from any of a number of suitable materials such as bonded or bundled nylon or polyester fibers, continuous-cell polyurethane foam, glass beads, fibers or plates, or sintered plastic. The capillary pressure and wetting characteristics of the wicking material are important, as discussed below.

Ink in the free-ink volume 30 flows into the wicking material through the gap 36 and out of the wicking material through an outlet 54 formed in the front wall 52 of the container. In this regard, a preferred embodiment of the supply container 20 is adapted to be remote or separate from the ink-jet pen that carries the printhead. Thus, an interconnect mechanism 60 is used to connect the supply container with a remote pen (not shown).

The interconnect 60 is a tubular member having an outside diameter matching the diameter of the outlet 54. The end of the interconnect 60 is inserted into the outlet into firm contact with the wicking material 50. A flange 62 may be carried on the interconnect 60 to ensure a firm, leak-proof connection. Any of a variety of means (such as O-rings) may be employed for sealing this connection. Until this connection is made, the outlet 54 may be sealed with, for example, disposable tape, which is removed just before the interconnect 60 is inserted into the outlet 54.

The ink is drawn from the wicking material by suction applied to the interconnect 60. This is schematically shown as a pump 64 coupled to the interconnect. In this regard, the printhead may be considered a pump whereby the ejection of ink droplets therefrom, along with the capillarity channels etc leading to the chambers provide the suction for drawing ink through the interconnect.

Porous, absorbent accumulator material 70 is placed atop the wicking material 50 in the capillary volume. The accumulator material 70, as was the wicking material, is generally characterized as "foam," but can be selected from any of a number of suitable materials such as bonded or bundled nylon or polyester fibers, continuous-cell polyurethane foam, glass beads, fibers or plates, or sintered plastic. The capillary pressure and wetting characteristics of the accumulator material are discussed below.

The accumulator material 70 fits snugly in the capillary volume 32, in direct contact with the wicking material 50, with the front and sidewalls of the container, and with the divider 22. No air space is provided between the accumulator material 70 and the wicking material 50. A small air space is provided between the top of the accumulator material 70 and the top 24 of the container.

The container 20 is filled with ink by any of a variety of means. For example, the free-ink volume 30 may be filled with ink that is directed through a port through the top 24, which port is thereafter sealed. A filled, free-ink volume has an ink level 72 very near the top 24 of the container, so that there is substantially no air gap in the top of the filled volume 30. For illustrative purposes, FIG. 1 shows the ink level 72 at a position where it would be if some of the ink had been depleted from the supply via use of the pen. Thus, a volume of trapped air 35 also appears in FIG. 1.

In a preferred embodiment, at least part of the container wall is transparent in the vicinity of the free-ink volume so that the level of ink 72 in that volume can be detected visually or by optical mechanisms.

The accumulator material 70 and wicking material 50 may be saturated with ink delivered by needles that protrude from a pressurized bulk source of ink and that pierce the material through the vent 38 and outlet 54, respectively. After filling, the outlet is sealed, as noted earlier.

An initial back pressure is established in the filled supply. To this end, a small amount of ink may be drawn from the saturated accumulator material 70 so that the capillarity of the part saturated material provides the initial back pressure. Additionally, slight suction may be applied to the free-ink volume as that filled volume is sealed.

Once the interconnect 60 is coupled to the outlet 54 and suction applied thereto, ink is drawn from the volumes of the supply in a particular order in accordance with the underlying invention. More particularly, the capillary pressure of the wicking material 50 is selected or established to be greater than the capillary pressure of the bubble generator 40 and of the accumulator material 70. As a result, the wicking material remains saturated with ink until ink is respectively drawn from the accumulator material 70 and the free-ink volume 30. The wicking material 50, in its saturated state, thus serves as a low resistance conduit of ink to the interconnect 60.

The capillary pressure of the accumulator material 70 is selected or otherwise established to be significantly lower than the capillary pressure of the bubble generator 40. In a preferred embodiment, the capillary pressure of the bubble generator 40 may be over 50 percent greater than that of the accumulator material. For instance, in one preferred embodiment the capillary pressure of the accumulator material is 7.5 cm water column, and the bubble generator capillary pressure is 12.5 cm water column. As a result, suction applied to the saturated wicking material 50 first draws the ink stored in the accumulator material 70 (under a relatively low capillary pressure) before ink is drawn from the free-ink volume (which can not be drawn until the relatively high capillary pressure of the bubble generator is overcome).

It will be appreciated that the capillary pressure of the accumulator material 70 (as well as that of the wicking material 50) may be established in a number of ways. For example, the aforementioned foam can be compressed in the capillary volume 32 to reduce the effective pore size of the material and thereby increase the associated capillary pressure.

One advantage of drawing the ink from the accumulator material first is that the portion of the accumulator material that is drained of ink is thereafter available to serve as an accumulator in the event that the partly empty container is exposed to extremes in ambient temperature and/or pressure. This will be discussed more below.

In order to enhance the volumetric efficiency of the supply, the accumulator material 70 is selected so that little ink will be stranded in it when the material is drained. To this end, the material is selected to have a "wetting" or "wettable" characteristic (as opposed to a non-wetting characteristic). That is, the angle between the liquid surface of the ink stored in the accumulator material and the solid surface of that material is zero, or very near zero. A wettable surface offers less resistance to ink flow than a non-wettable surface. As a result, the accumulator material 70 tends to have little stranded ink once the supply is empty.

Under some conventions, a contact angle of less than 90 degrees defines a wettable surface. While a contact angle of 90 degrees or less will suffice in the case at hand, it is preferred that the accumulator material have a contact angle as close to zero as practical.

Under normal operation of the supply (that is, ink drawn from the supply while ambient pressure and temperature have little variation), ink flows out of the free-ink volume 30 once the accumulator material 70 is drained. In this regard, the free-ink will not flow until the back pressure in that volume 30 is overcome. The capillary pressure of the bubble generator 40 regulates the back pressure in the free-ink volume by allowing ambient air bubble entry once that back pressure builds to a level slightly greater than the capillary pressure of the bubble generator. As noted above, however, the relatively lower capillary pressure in the accumulator material 70 makes flow from that material 70 the path of least resistance from a hydraulic standpoint.

It is noteworthy here that the highest capillary pressure in this system is that provided by the wicking material 50. Thus, once the accumulator material 70 is drained, the lowest capillary pressure is that of the bubble generator 40, so that ink is next drawn from the free-ink volume 30 until it is emptied.

In a preferred embodiment, the bubble generator 40 is configured so that its opening 42 is very near the bottom wall 28 of the container. To this end, a tubular member, separate from the divider 22 may be employed (as mentioned above) or a downward extension of the divider may be formed in the vicinity of the bubble generator so that the bubble generator reaches the bottom of the container without otherwise diminishing the gap 36.

If design constraints require the bubble generator to be located above the bottom wall 28 of the container, the bubble generator could be designed to trap a small amount of ink in its end 42 to serve as a liquid seal to maintain back pressure even after the level of the free ink moves below that end 42. The use of a trap may be omitted in instances where the bubble generator is above the bottom wall 28. Thus, back pressure in the volume 30 will be lost once the ink level there moves to below the opening 42. In this embodiment, the size of the accumulator material may be supplemented to absorb the volume of ink that remains in the free-ink 30 once back pressure is lost. That volume may then be drained from the accumulator material during printing.

It may be desirable, as noted above, to drain the wicking material 50 of ink once the free-ink volume is empty. To this end, the capillary pressure of the wicking material is established to be higher than the bubble generator capillary pressure but less than the suction applied by the interconnect 60. Thus, the wicking material is drained after the free-ink volume 30.

In the embodiment where the wicking material 50 is to be drained, it is preferred to select that material to have a very small, near zero contact angle as described above with respect to the accumulator material 70.

Inasmuch as the accumulator material 70 is drained before the filled, free-ink volume 30 begins to drain, there is practically no trapped air 35 (trapped air being air introduced into the free-ink volume via the bubble generator 40) above the free-ink level 72 until the accumulator material 70 is drained. After such draining, the ink level 72 drops and the volume of trapped air 35 grows as ink is drawn from the free-ink volume.

Turning now to the accumulator aspects of the present system, a part-empty container (that is, part of the free-ink volume is empty and the accumulator material is drained) may be subjected to an ambient pressure drop (or temperature increase). In the absence of a means to compensate for such a change, a pressure gradient relative to the trapped air volume 35 would be present and the back pressure would drop to a level where ink would be free to drool from the connected printhead.

With the present arrangement of supply components, however, the ink volume that moves into the wicking material 50 as a consequence of the expanding trapped air volume 35 (expanding, that is, as a result of the pressure gradient just mentioned) is drawn into the accumulator material 70 to reduce pressure in the free ink volume and thereby maintain an adequate back pressure in the supply to prevent drooling from the printhead. Should the ambient pressure then return to normal (eliminating the pressure gradient), the resultant contraction of the trapped air volume 35 and attendant increase in back pressure inside the supply will draw ink back from the accumulator material 70 (again, via the saturated wicking material 50) until the system returns to its state of equilibrium.

It may be that a part empty container will be subjected to an ambient pressure increase instead of a decrease (or temperature decrease) that, in the absence of a means to compensate for such a change, would cause a pressure gradient relative to the trapped air volume 35 (the air volume would contract) such that the back pressure would rise to a level such that ink would cause the printhead to fail since it would overcome the suction of the interconnect 60.

With the present arrangement of supply components, however, the back pressure increase attributable to the air volume contraction would draw air bubbles through the bubble generator 40. In this regard, the accumulator material 70 is empty, as explained above, and the wicking material 50 has a higher capillary pressure than the bubble generator 40, so ink would not be drawn from that saturated material 50. Thus, the air bubbling through the bubble generator immediately reduces the back pressure rise caused by the contracting trapped air volume, thus keeping the back pressure within the operating range.

Should the ambient pressure thereafter return to normal (eliminating the pressure gradient), the resultant expansion of the trapped air volume 35 and attendant decrease in back pressure will allow the empty accumulator material 70 to absorb the volume of ink displaced by such expansion. Because the accumulator material has the lowest relative capillary pressure of the supply components, subsequent printing of ink will thereafter drain the accumulator material before drawing on the free-ink volume 30.

In view of the foregoing, it will be appreciated that the supply system just described is robust and able to respond to an indefinite number of temperature- and pressure-change cycles irrespective of the amount of ink remaining in the supply.

The accumulator material 70 must be large enough to absorb all of the ink transferred to it from the free-ink volume 30 as a result of the pressure gradients and associated trapped air volume changes just described. Moreover, volumetric efficiency demands that the size of the accumulator material be optimized; that is, sized just large enough, and no larger, to compensate for a prescribed temperature or pressure change applied to a free-ink volume irrespective of the amount of ink remaining in that volume. In accordance with another aspect of the present invention, this description now turns to a technique for so optimizing that size.

Figure 2:
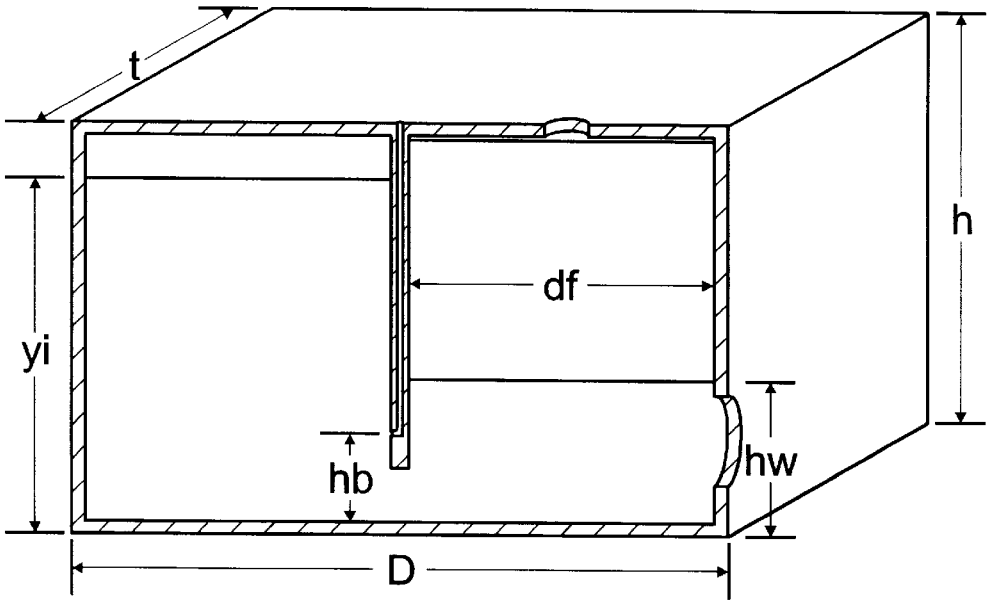
FIG. 2 is a diagram similar to FIG. 1 for depicting certain dimensions of the supply to illustrate the aspect of this invention concerning optimizing the size of the accumulator material.

The technique can be most readily understood with reference to FIG. 1 and 2, which diagrams represent a simple configuration of the supply container 20.

Assuming for ease of explanation that the height h, depth D, and width t of the container 20 are constrained by other design considerations, the amount of accumulator material 70 needed to optimally handle the pressure gradients just described can be expressed as the variable df, which will be referred to as foam depth.

The largest (albeit not necessarily optimal) amount of accumulator material 70 required would be the volume necessary for absorbing substantially all of the free-ink volume should a small volume of trapped air 35 expand enough to force all of the ink from the free-ink volume. For a selected range of temperature and pressure changes, such as a designer might anticipate, and the external geometry given above, the depth of foam df can be calculated as a function of the ink height in the free-ink volume. An analysis follows, using an anticipated temperature range of 35° C. and an ambient pressure range of 255 cm of water column, which approximately corresponds to an 8000-foot elevation change.

| Given: | | | |
|---|---|---|---|
| γ = | specific weight of ink; | PI = | Capillary pressure of accumulator material |
| h = | height of the supply container 20; | nl = | Volumetric efficiency of accumulator material (porosity × ink extraction efficiency) |
| D = | overall depth of the container; | T1 = | initial temperature of anticipated range |
| t = | thickness of the container; | T2 = | final temperature of anticipated range |
| hb = | height of bubble generator above bottom wall | Pa1 = | initial ambient pressure of anticipated range |
| hw = | height of wicking materail above bottom wall | Pa2 = | final ambient pressure of anticipated range |
| Pb = | capillary pressure of bubble generator | Vc | container volume of t D h |

One can determine the foam depth df as a function of the ink height yi1 in the free-ink volume at T1 and Pa1, along with the optimal maximum foam depth dfmax, delivered ink volume Vd (which is the volume of ink delivered from the supply), stranded ink volume Vs (which is the volume of ink stranded in the ink supply when the supply is otherwise empty), and delivered ink efficiency nd (which is the ratio of delivered ink to the container volume or Vd/Vc).

Before proceeding it is noted that certain assumptions are made in the analysis. They are (1) dissolved gases in the ink are neglected, (2) the air in the trapped air volume 35 is treated as an ideal gas mixture of air and water vapor, (3) the partial pressure of the vapor is equal to the saturation pressure of the vapor at the temperature of interest and can be obtained from the steam tables, and (4) condensate in the ink volume is neglected.

At T1 and at T2 the total moles of the trapped air equals the moles of air plus the moles of vapor, or:

$$ng1=nga1+ngv1 \text{ and}$$

$$ng2=nga2+ngv2.$$

Assuming no air transfer (nga1=nga2) and subtracting yields $$ng1-ng2=ngv1-ngv2 \quad \text{(Eq. 1)}$$

Thus, the total change in moles equals the change in vapor moles due to evaporation/condensation. For an ideal gas mixture:

$$Pg\ Vg=ng\ R\ T$$

Solving the preceding equation for ng1, ng2, ngv1, and ngv2, and substituting in equation 1 yields:

$$ng1=(Pg1\ Vg1)/R\ T1$$

$$ng2=(Pg2\ Vg2)/R\ T2$$

$$ngv1=(Pgv1\ Vg1)/R\ T1 \text{ and}$$

$$ngv2=(Pgv2\ Vg2)/R\ T2$$

where Pgv is the partial pressure of the vapor, considering the Dalton Model for gaseous mixtures.

Assuming, as noted, that the partial pressure of the vapor is equal to the saturation pressure Psat of the vapor at the temperature of interest and is obtained from the steam tables, one finds from Equation 1:

$$[(Pg1\ Vg1)/T1]-[(Pg2\ Vg2)/T2]=[(Psat1\ Vg1)/T1]-[(Psat2\ Vg2)/T2]$$

thus $$[(Pg1-Psat1)Vg1]/T1=[(Pg2-Psat2)Vg2]/T2 \quad \text{(Eq. 2)}$$

Since the total volume of ink does not change:

$$Vi1+Vf1=Vi2+Vf2 \quad \text{(Eq. 3)}$$

where Vi is the volume of free ink and Vf is the volume of ink in the "foam" wicking and accumulator material. With the foregoing equations at hand, the general solution is considered under the following parameters:

At T1:

yi=yi1 yfl=hw (height of ink in "foam"–accumulator material empty, bubble generator active)

Pg1=Pa1−Pb−γ(yi1−hb)

Vg1=t(D−df)(h−yi1)

Vi1=t(D−df)yi1

Vf1=nl t df(yfl−hw)=0 (accumulator material initially empty)

Psat1 (from steam tables)

Pa1 (from standard atmosphere at sea level)

The foregoing expression, Pg1=Pa1−Pb−γ(yi1−hb), represents the pressure of the trapped air in the volume 30. That pressure is the ambient pressure, reduced by the bubble generator capillary pressure and by the hydrostatic head pressure (the hydrostatic pressure being measured from above the height hb of the bubble generator).

At T2:

yi=yi2 yf2=h(assume the accumulator material is full for maximum utilization)

Pg2=Po−γ yi2 where

Po=Pa2−Pl+γ yf2 (pressure at the bottom of the container)

Vg2=t(D−df)(h−yi2)

Vi2=t(D−df)yi2

Vf2=nl t df(yf2−hw)

Psat2 (from steam tables)

Pa2 (from standard atmosphere at 2438 meters)

Recognizing that the maximum amount of accumulator material required, which corresponds to the maximum volume of free ink displaced into the foam, occurs for the condition in which the initial free ink level corresponds to a trapped air volume that will expand just enough to completely displace the free ink into the accumulator material, then the final free ink level height after such expansion can be written as:

$$yi2=0 \quad \text{(Eq. 4)}$$

Using the previously listed parameters and substituting Equation 4 into Equation 2 yields:

$$[Pa1-Pb-\gamma(yi1-hb)-Psat1](h-yi1)/T1=(Pl-P1+\gamma\ h-Psat2)\ h/T2 \quad \text{(Eq. 5)}$$

The solution for df is from Equation 3, substituting the appropriate parameters to yield:

$$t(D-df)yi1+0=t(D-df)yi2+nl\ t\ df(h-hw)$$

or $$D(yi1-yi2)=df\ [(yi1-yi2)+nl(h-hw)],\ \text{which yields to:}$$

$$df=[D(yi1-yi2)]/[yi1-yi2+nl(h-hw)] \quad \text{(Eq. 6)}$$

Substituting Equation 4 into Equation 6 yields:

$$df=[D\ yi1]/[yi1+nl(h-hw)] \quad \text{(Eq. 7)}$$

Equations 5 and 7 may be solved for yi1 and df. To solve Equation 5 for yi1, it is rearranged into a polynomial in yi1:

$$[Pa1-Pb-\gamma(yi1-hb)-Psat1](h-yi1)=T1/T2(h)(Pa2-Pl+\gamma\ h-Psat2)$$

One can set the right half of the preceding equation equal to R, which reflects a constant dependent upon the chosen design conditions, geometries, and ink properties. Expanding that equation and collecting terms yields:

$$\gamma\ yi1^2+(-\gamma\ h-Pa1+Pb-\gamma\ hb+Psat1)yi1+(Pa1\ h-Pb\ h+\gamma\ h\ hb-Psat1\ h-R)=0 \quad \text{(Eq. 8)}$$

Equation 8 is a second degree polynomial in yi1, its coefficients depend only on constants and it may be solved using the quadratic formula:

Let:

$a=\gamma$;

$b=-\gamma\ h-Pa1+Pb-\gamma\ hb+Psat1$;

$c=Pa1\ h-Pb\ h+\gamma\ h\ hb-Psat1\ h-R$

Then:

$$yi1=[-b+/-(b^2-4ac)^{1/2}]/2a \quad \text{(Eq. 9)}$$

The solution for yi1 is valid over the domain: $0<yi1<h$ and is typically the lesser root of Equation 9.

To determine the required amount of accumulator material, one substitutes the solution for yi1 into Equation 7, which is a function only of constants and yi1.

Using the foregoing, the required amount of accumulator material dfmax was determined to be 26.8 mm for the following container sizes and conditions:

| | | | |
|---|---|---|---|
| γ = | 10297 N/m$^3$ | Pl = | 7.62 cm |
| h = | 52.75 mm | nl = | 0.64 |
| D = | 65.0 mm | T1 = | 0° C. |
| t = | 7.0 mm | T2 = | 35° C. |
| hb = | 7.0 mm | Pa1 = | 1033 cm H20 |
| hw = | 9.0 mm | Pa2 = | 778 cm H20 |
| Pb = | 12.7 cm ink | Psat1 = | 0.6113 kPa |
| yi1 = | 19.6 mm | Psat2 = | 5.6280 kPa |

Once dfmax is determined, one can determine the delivered ink volume Vd (which is the volume of ink delivered from the supply), the stranded ink volume Vs (which is the volume of ink stranded in the ink supply when the supply is otherwise empty), and the delivered ink efficiency nd (which is the ratio of delivered ink to the container volume or Vd/Vc)

Before these determinations, however, additional accumulator material characteristics are developed; namely:

$n_{pa}$=porosity of accumulator material; ratio of void volume to bulk volume of the material; (for example, 0.85)

$n_{pw}$=porosity of wicking material; ratio of void volume to bulk volume of the material; (for example, 0.85)

$n_{ea}$=extraction efficiency of accumulator material; fraction of total ink in the material that can by extracted by the printhead; (for example, 0.75)

$n_{ew}$=extraction efficiency of wicking material; fraction of total ink in the material that can by extracted by the printhead; (for example, 0.75)

$n_a$=overall efficiency of the accumulator material; the product of $n_{pa}$ and $n_{ea}$ $n_w$=overall efficiency of the wicking material; the product of $n_{pw}$ and $n_{ew}$ The greatest delivered ink efficiency $n_d$ is obtained when the ink supply is designed so that both the accumulator material 70 and the wicking material 50 may be drained by the interconnect. Accordingly, the delivered ink volume for such a situation is the sum of the ink delivered from the free-ink volume, the accumulator material, and the wicking material, or:

$$Vd=t(D-dfmax)h+n_a\ t\ dfmax(h-hw)+n_w\ t\ dfmax\ hw \quad \text{(Eq. 10)}$$

The stranded ink volume is dependent on the extraction efficiency and porosity of both the accumulator material and the wicking material, or:

$$Vs=[(1-n_{ea})n_{pa}\ dfmax\ t\ (h-hw)]+[(1-n_{ew})n_{pw}\ dfmax\ t\ hw] \quad \text{(Eq. 11)}$$

As noted above, the delivered ink efficiency is:

$$n_d=Vd/Vc \quad \text{(Eq. 12)}$$

Using the foregoing equations and exemplary values, the ink supply provided a delivered ink efficiency of greater than 85% which is an impressively high efficiency, especially when one considers that the supply, which combines free ink and foam-stored ink, also provides back pressure control, thus obviating the need other such regulating means.

Thus, while the present invention has been described in terms of a preferred embodiment, it will be appreciated by one of ordinary skill that the spirit and scope of the invention is not limited to those embodiments, but extend to the various modifications and equivalents as defined in the appended claims.

What is claimed is:

1. An ink container comprising:

a reservoir that is divided into a free-ink volume and a capillary volume, each volume configured for storing ink;

an outlet formed in the reservoir to enable ink to flow out of the capillary volume;

porous wicking material having a first capillary pressure and located inside the capillary volume adjacent to the outlet;

accumulator material located in the capillary volume and being absorbent for storing ink therein, the accumulator material contacting the wicking material and having a second capillary pressure;

the wicking material being in fluid communication with the free-ink volume; and a bubble generator having a capillary pressure that is less than the first capillary pressure but greater than the second capillary pressure, the bubble generator being located to connect the free-ink volume with ambient air.

2. The container of claim 1 wherein the accumulator material has a surface selected so that a contact angle between ink stored therein and the surface of the accumulator material is less than ninety degrees, such that the accumulator material has a wettable surface.

3. The container of claim 2 wherein the contact angle is very near zero degrees.

4. The container of claim 1 wherein the capillary pressure of the bubble generator is at least 67% greater than the second capillary pressure.

5. The container of claim 1 further comprising interconnect means for connecting to the outlet and providing suction for removing ink through the outlet, the wicking material having a capillary pressure that is greater than the suction applied by the interconnect means.

6. The container of claim 1 further comprising interconnect means for connecting to the outlet and providing suction for removing ink through the outlet, the wicking material having a capillary pressure less than or equal to the suction applied by the interconnect means.

7. The container of claim 1 wherein the accumulator material has a wetting characteristic such that a contact angle between the ink and the surface of the accumulator material is near zero.

8. The container of claim 7 wherein the accumulator material is formed of glass.

9. The container of claim 7 wherein the accumulator material is made from polyester fibers.

10. The container of claim 7 wherein the accumulator material is made from bonded fibers.

11. The container of claim 10 wherein the fibers are nylon.

12. A method of sizing an ink supply reservoir for a printer, comprising the steps of:

providing a three-dimensional reservoir for storing ink such that the reservoir is divided into a free-ink volume and into a capillary volume;

establishing two of the three dimensions for the free-ink volume and the capillary volume, one of those established dimensions being height, wherein ink is stored in the free-ink volume at any height within a range of ink heights in the free-ink volume, and wherein ink-absorbent accumulator material is located in the capillary volume; and determining the third dimension of the capillary volume as a function of two different ink heights in the range of ink heights.

13. The method of claim 12 including the steps of:

providing an outlet in the reservoir for ink stored in the reservoir to flow therefrom; and locating adjacent to the outlet and contacting the accumulator material a volume of wicking material that is also in fluid communication with the free-ink volume.

14. The method of claim 13 including the step of connecting the free-ink volume to ambient with a tubular member having a capillary pressure that is selected to be greater than the capillary pressure of the accumulator material.

15. A method of storing ink in a container for delivery therefrom through an outlet, the method comprising the steps of:

storing a portion of the ink in a first part of the container that defines a volume that is sealed from ambient but for an opening that has a first capillary pressure;

storing the remaining portion of the ink in a second part of the container that defines a volume that is part filled with porous accumulator material that has a second capillary pressure that is substantially lower than the first capillary pressure; and locating porous wicking material having a third capillary pressure in the container in contact with the accumulator material and in fluid communication with the first part of the container and with the outlet.

16. The method of claim 15 including the step of selecting the wicking material such that the third capillary pressure is greater than the first capillary pressure.

17. The method of claim 15 including the step of selecting the accumulator material so that a contact angle between the ink and the surface of the accumulator material is near zero.

18. The method of claim 15 further comprising the steps of sizing the container and selecting the accumulator and wicking material such that greater than 85% of the ink in the first and second container parts is delivered through the outlet.

* * * * *